US005209710A

United States Patent [19]

Shimizu et al.

[11] Patent Number: 5,209,710

[45] Date of Patent: May 11, 1993

[54] TREADMILL

[75] Inventors: Masaharu Shimizu; Harutoshi Terasawa, both of Tokyo, Japan

[73] Assignee: Nihon Kohden Corporation, Tokyo, Japan

[21] Appl. No.: 853,972

[22] Filed: Mar. 20, 1992

[30] Foreign Application Priority Data

Mar. 28, 1991 [JP] Japan ..... 3-26491

[51] Int. Cl.[5] ..... A63B 23/00

[52] U.S. Cl. ..... 482/54; 482/51

[58] Field of Search ..... 482/51, 54, 900, 901, 482/903, 8; 119/29; 128/25 R, 25 B, 779, 782; 364/413.01, 561

[56] References Cited

U.S. PATENT DOCUMENTS

| | | | |
|---|---|---|---|
| 4,600,016 | 7/1986 | Boyd et al. | 128/779 X |
| 4,708,337 | 11/1987 | Shyu | 482/54 |
| 5,033,013 | 7/1991 | Kato et al. | 364/561 |
| 5,065,414 | 11/1972 | Endou et al. | 482/8 |

*Primary Examiner*—Richard J. Apley
*Assistant Examiner*—Glenn Richman
*Attorney, Agent, or Firm*—Hoffmann & Baron

[57] ABSTRACT

A treadmill has a belt provided with a running surface and rotated in a predetermined direction at a set running speed, wherein a foot landing on the running surface is detected, a landing time distance between landing times is measured, and a stride is calculated from the running speed of the running surface and the landing time distance measured and indicated or recorded on an output device.

10 Claims, 3 Drawing Sheets

TREADMILL

BACKGROUND OF THE INVENTION

1. Field of the Invention

The present invention relates to a treadmill comprising a belt which has a running surface and which is rotated at a set speed in a predetermined direction.

2. Description of the Related Art

In a conventional treadmill, a running speed and, in some cases, the slope of a running surface are set and indicated.

On the other hand, it is important for sport training by a treadmill to run while recognizing the stride. In such a case, for example, the time required for walking 20 steps is measured by a stop watch and divided by the number of steps. This measurement using a stop watch not only requires a person for measurement but also easily produces error in the measurement.

Walking is also employed for maintaining or promoting health. However, persons are apt to unconsciously behave without loading the bodies, and the stride decreases with an increase in age. Walking with long steps is also effective for increasing the staying power of the heart and lungs. It is therefore encouraged to walk with steps increased by, for example, 3 to 5 cm, in constant rhythm while keeping the back straight. However, such training is difficult to make on a road, and it is thus convenient to train using a treadmill while confirming the stride by oneself.

SUMMARY OF THE INVENTION

Accordingly, it is an object of the present invention to provide a treadmill which is capable of automatically measuring the stride of running or walking and indicating or recording it.

A treadmill of the present invention comprises landing detection means for detecting a foot landing on a running surface, timer means for measuring a landing time distance between the detected landing times, and stride calculating means for calculating a stride by multiplying the lading time distance measured by a running speed.

The treadmill of the invention is capable of automatically measuring the real time stride of walking or running or the moving average stride by real-time or intermittent measurement and thus enables persons to perform self training of walking or running while being aware of the stride. The treadmill is also extremely effective for guiding sport training. The treadmill can also be used for walk training of persons of advanced age or guiding the persons in walk training for maintaining or promoting health. The applicability of the treadmill or the age group using the treadmill is also widened.

The treadmill is provided with a stride discriminating means for distributing the strides calculated for a predetermined number of steps to a group of even numbers of steps and a group of odd numbers of steps, and an average stride calculating means for respectively calculating average strides of the even and odd groups so that a difference between the strides of the right and left feet can be recognized.

DETAILED DESCRIPTION OF THE INVENTION

Figure 1:
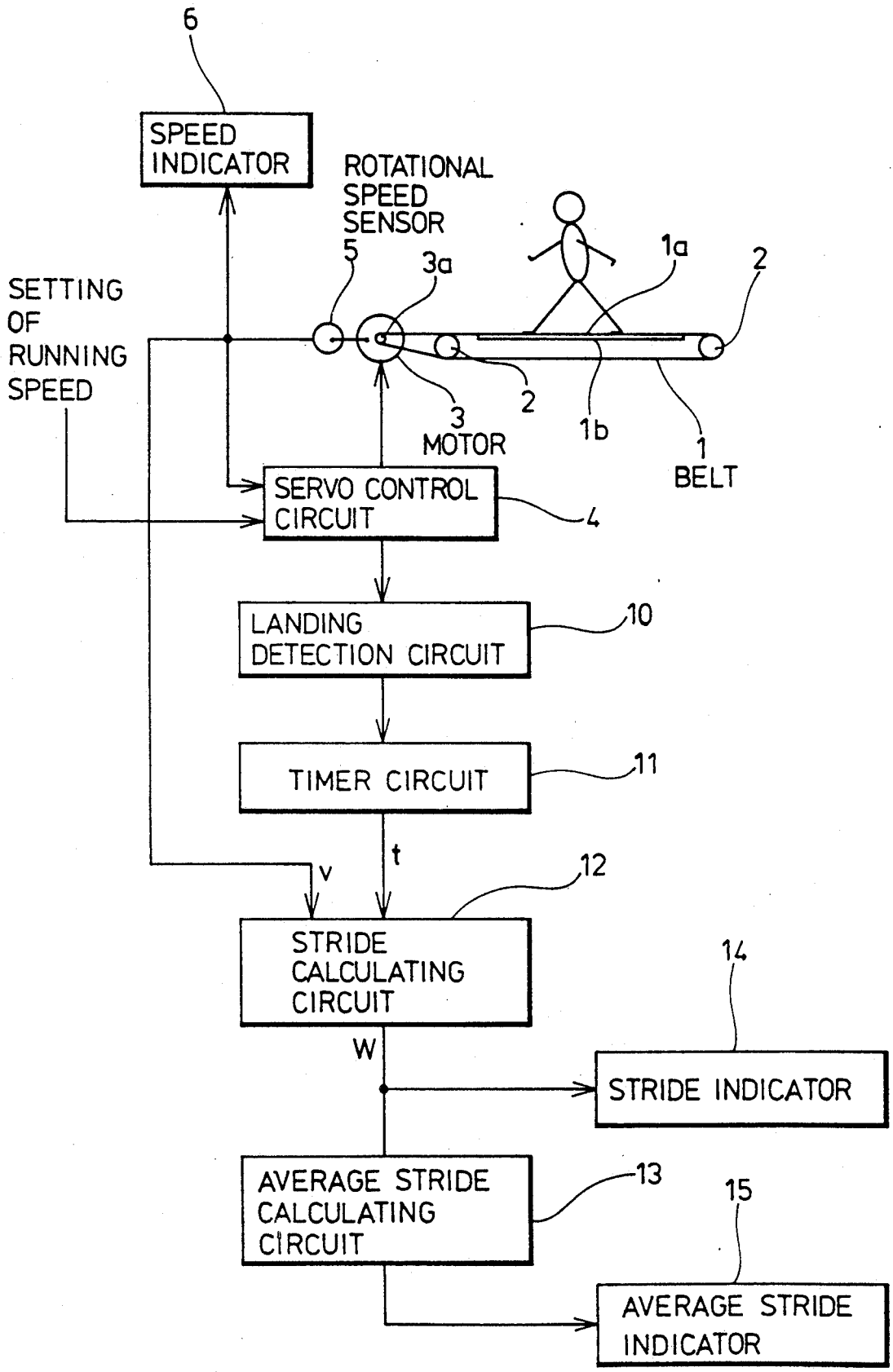
FIG. 1 is a drawing showing the configuration for measurement by a treadmill with a stride display device in accordance with an embodiment of the present invention.

FIG. 1 shows a treadmill in accordance with an embodiment of the present invention. In the treadmill, a belt 1 which is wound on a roller 2 and the rotational shaft of a motor 3 and which is mounted on a running plate **1*b* is rotated in a predetermined direction as an endless belt conveyor. The surface of the belt 1 is used as a running surface la for training of walking or running or a sport load for maintaining health or examination. The motor 3 is provided with a servo control circuit 4 driven according to the set running speed, and the rotational speed thereof is detected by a rotational speed sensor 5 such ass a tachometer, a rotary encoder or the like and indicated on a speed indicator 6**.

The treadmill of the invention comprises a landing detection circuit 10 for detecting a foot landing on the running surface **1*a* on the basis of the detection signal output from the rotational speed sensor 5, which corresponds to an instantaneous speed reduction, a timer circuit 11 for measuring a landing time distance t between the detected landing times, a stride calculating circuit 12 for calculating a stride W from the running speed v of the running surface 1*a* and the landing time distance t on the basis of $t \times v$, an average stride calculating circuit 13 for calculating an average stride by successively obtaining moving averages of the strides calculated for a predetermined number of steps, and a stride indicator 14 and an average stride indicator 14*a* both of which are serving as output means for indicating the calculated stride and the average stride, respectively. For example, if strides of an even number of steps, e.g., ten times of landing, are detected, the average stride calculating circuit 13** calculates the average stride of the ten steps and then outputs a next average stride while successively renewing the averages at each time a landing is detected.

At each time a foot of a trainer is landed on the running plane **1*a*, the landing detecting circuit 10 thus detects an instantaneous speed reduction of the motor 3. At each time the detection signal is input to the timer circuit 11, the timer action of the timer circuit 11 is reset so that the landing time distance t is repeatedly measured. When the stride calculating circuit 12 receives the speed signal indicating the running speed v from the rotational speed sensor 5 and the signal indicating the landing time distance t, the stride calculating circuit 12 calculates a stride W at each landing and indicates it on the stride indicator 14 in real time. When the average stride calculating circuit 3 receives the stride signal for ten steps, the circuit 3 calculates an average stride for the ten steps and then successively calculates a moving average stride for ten steps and indicates it on an average stride indicator 15*a*** in real time.

Figure 2:
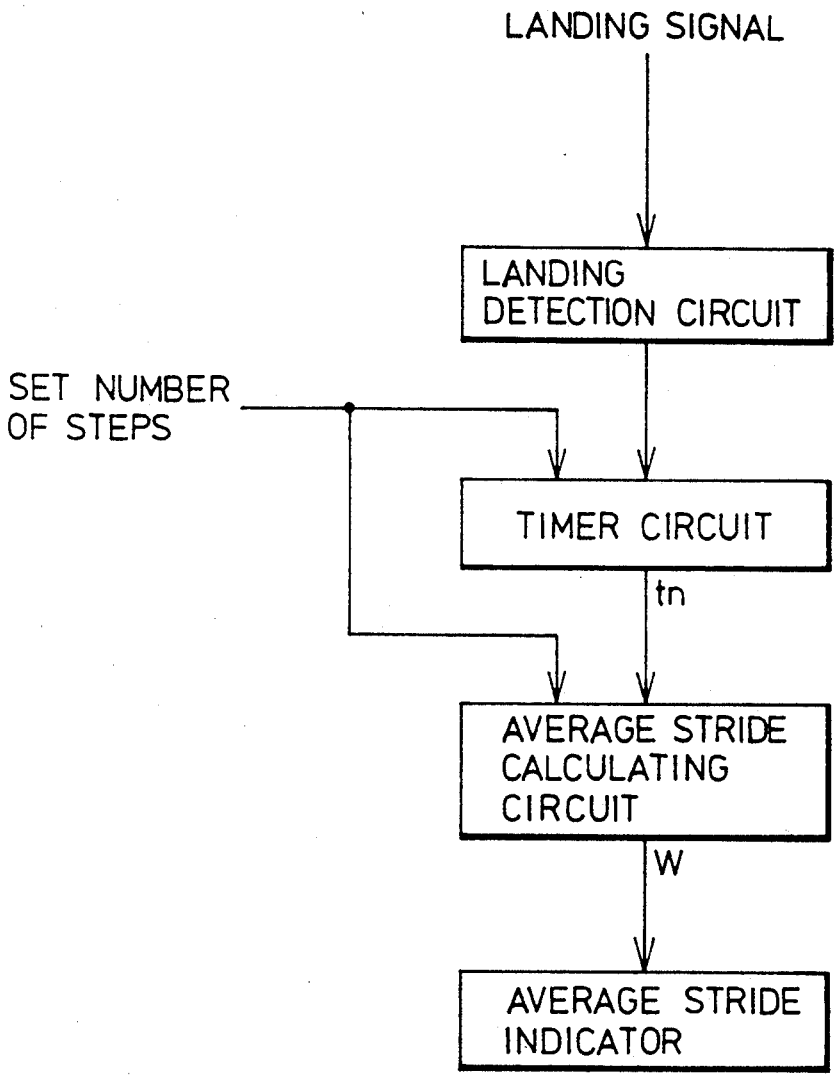
FIG. 2 is a drawing showing a principal portion for measurement by a treadmill with a stride display device in accordance with another embodiment of the invention.

In this embodiment, when an average stride only is calculated, a time distance for input of a predetermined number of landing signals may be measured and divided by the number of landing steps, without the stride detected for each step. As shown in FIG. 2, a timer circuit 18 for measuring a landing time distance tn between landing times, which corresponds to a predetermined number of steps, and an average stride calculating circuit 19 for calculating an average stride from a predetermined number n of steps on the basis of $(t_n \times v)/n$ by successively obtaining moving averages may be connected behind the landing detection circuit 10 shown in FIG. 1. In the average stride calculating circuits 13 and 19, if an average stride is calculated for every two landings, i.e., for each period, the strides of the right and left feet are averaged and indicated even if there is a difference between the strides of the right and left feet. Each of the average stride calculating circuits 13 and 19 may be designed as an intermittent average calculating circuit for calculating an average stride for ten steps and then calculating again an average stride for next ten steps while indicating the average stride and renewing the average stride, without obtaining moving averages. A landing may be detected by detecting an instantaneous increase in the motor driving current or employing a walking action detector such as a vibration detector set on the running plate 1*b*, an acceleration detector or the like, which is fitted to the waist of a trainer.

Figure 3:
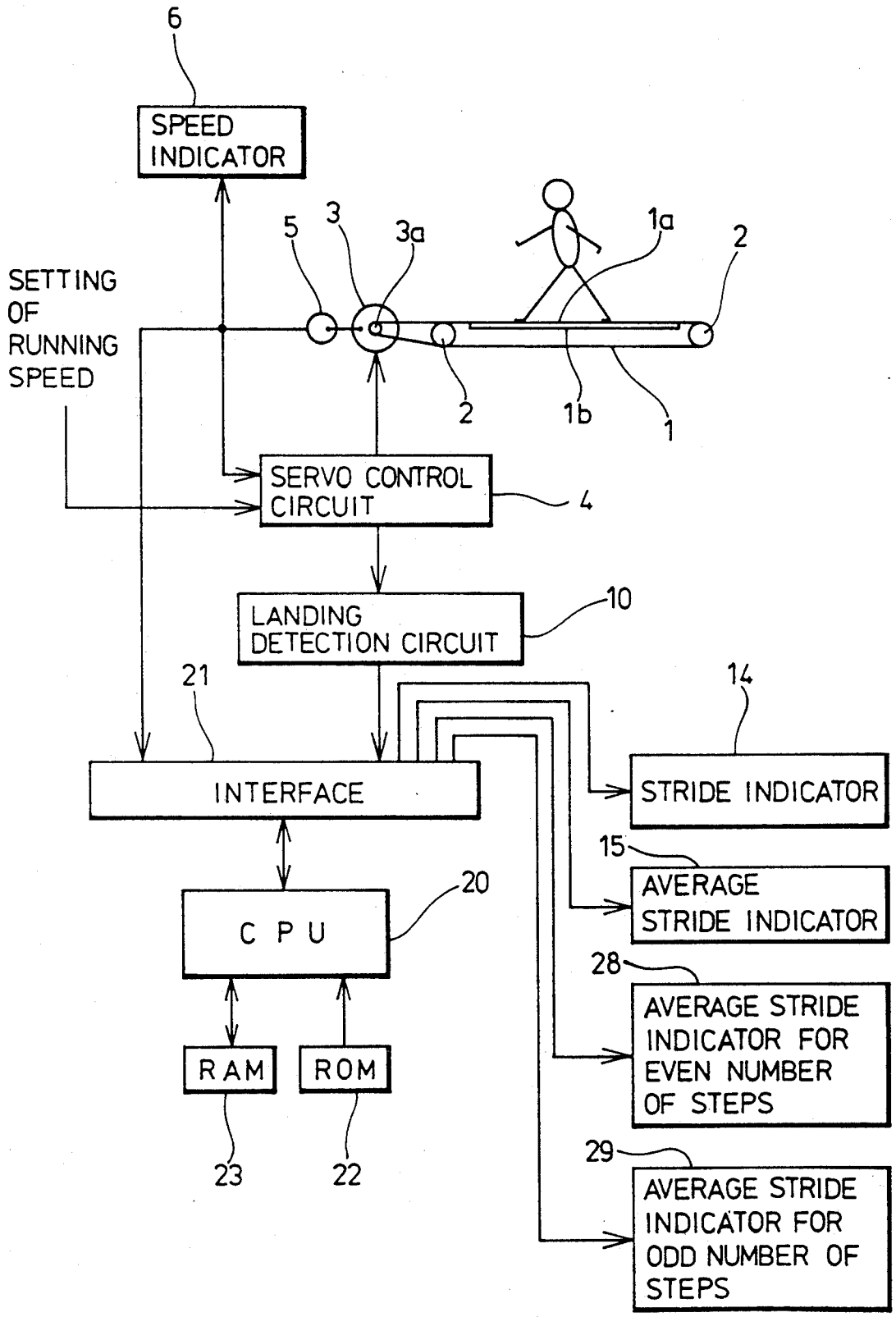
FIG. 3 is a drawing showing the configuration for measurement by a treadmill with a stride display device using a microcomputer according to the present invention.

FIG. 3 shows a treadmill which employs a CPU for carrying out the present invention. In FIG. 3, the same portions as and equivalent portions to those of the above-described embodiment are shown by the same reference numerals. A CPU 20 provided with an interface 21, an ROM 22 and an RAM 23 comprises stride calculating means, average stride calculating means, stride discriminating means for distributing the calculated strides to a stride group of even numbers of steps and a stride group of of odd numbers of steps and average stride calculating means for calculating an average stride of the right and left feet. Namely, the CPU 20 receives the landing detection signal, calculates the landing time distance t between the landing times detected by the timer contained therein and calculates the stride W on the basis of the rotational speed data v input from the rotational speed sensor 5. The CPU 20 also alternately distributes the stride data for 20 steps and respectively calculates the average strides of ten steps of even numbers and odd numbers. The stride data is indicated on the stride indicator 14, the average stride indicator 15 and average stride indicators 28, 29 for even numbers and odd numbers of steps, respectively. The CPU 20 also calculates the average stride for 20 steps.

It is thus possible to automatically determine the stride for each landing and the average stride for 20 steps by the indicators. In addition, when the user is aware of whether the left or right foot is first landed, it is possible to respectively determine the average strides of ten steps of the left and right feet and thus recognize an unbalance between the left and right strides.

Further, when the slope of the running surface can be adjusted, the angle of the slope is also indicated on the indicator attached to the treadmill.

What is claimed is:

1. A treadmill comprising:

a belt provided with a running surface and rotated in a predetermined direction at a set running speed;

landing detection means for detecting foot landings on said running surface;

timer means for measuring the landing time distance between the landing times detected;

stride calculating means for calculating a stride from the running speed of said running surface and said landing time distance measured; and output means for outputting the calculated stride.

2. A treadmill according to claim 1, wherein said landing detection means detects an instantaneous speed reduction at each foot landing using a rotational speed sensor for a belt driving motor.

3. A treadmill according to claim 1, wherein said landing detection means detects an instantaneous increase in the driving current of a belt driving motor at each foot landing.

4. A treadmill according to claim 1, wherein said landing detection means comprises a vibration detector provided on said running surface.

5. A treadmill according to claim 1, wherein said landing detection means comprises an action detector attached to a trainer.

6. A treadmill comprising:

a belt provided with a running surface and rotated in a predetermined direction at a set running speed;

landing detection means for detecting foot landings on said running surface;

timer means for measuring the landing time distance between the landing times detected;

stride calculating means for calculating a stride from the running speed of said running surface and said landing time distance measured;

average stride calculating means for calculating an average stride of the strides calculated for a predetermined number of steps; and output means for outputting said stride calculated.

7. A treadmill according to claim 6, wherein said average stride calculating means calculates an average stride by successively obtaining a moving average for a predetermined number of steps.

8. A treadmill according to claim 6, wherein said average stride calculating means intermittently calculates average strides for every predetermined number of steps.

9. A treadmill according to claim 6, further comprising stride discriminating means for distributing the strides calculated for a predetermined number of steps to a stride group of even numbers of steps and a stride group of odd numbers of steps so that said average stride calculating means respectively calculates the average strides of the even and odd stride groups, which are discriminated.

10. A treadmill comprising:

a belt provided with a running surface and rotated in a predetermined direction at a set running speed;

landing detection means for detecting foot landings on said running surface;

timer means for measuring the landing time distance between the landing times detected;

stride calculating means for calculating a stride from the running speed of said running surface and said landing time distance measured;

average stride calculating means for calculating an average stride of the calculated strides from the running speed of said running surface, the calculated landing time distance and a predetermined number of steps; and output means for outputting the calculated average stride.

* * * * *

UNITED STATES PATENT AND TRADEMARK OFFICE

CERTIFICATE OF CORRECTION

PATENT NO. : 5,209,710

DATED : May 11, 1993

INVENTOR(S) : Shimizu et al.

It is certified that error appears in the above-identified patent and that said Letters Patent is hereby corrected as shown below:

Column 3, Line 3, "tn" should be --$t_n$--

Signed and Sealed this

Ninth Day of May, 1995

*Attest:*

*Attesting Officer*

BRUCE LEHMAN

*Commissioner of Patents and Trademarks*